US007943276B2

(12) United States Patent
McGuire et al.

(10) Patent No.: US 7,943,276 B2
(45) **Date of Patent: *May 17, 2011**

(54) IMAGING MEMBER

(75) Inventors: Gregory McGuire, Oakville (CA); Ah-Mee Hor, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 17 days.

This patent is subject to a terminal disclaimer.

(21) Appl. No.: 12/332,578

(22) Filed: Dec. 11, 2008

(65) Prior Publication Data

US 2010/0151371 A1 Jun. 17, 2010

(51) Int. Cl.
*G03G 5/06* (2006.01)

(52) U.S. Cl. ..... 430/58.05; 430/58.8

(58) Field of Classification Search ..... 430/58.8, 430/58.05

See application file for complete search history.

(56) References Cited

U.S. PATENT DOCUMENTS

| | | | | |
|---|---|---|---|---|
| 2,297,691 | A | 10/1942 | Carlson | |
| 3,041,167 | A | 6/1962 | Blakney et al. | |
| 4,251,612 | A | 2/1981 | Chu et al. | |
| 4,265,990 | A | 5/1981 | Stolka et al. | |
| 4,306,008 | A * | 12/1981 | Pai et al. | 430/58.8 |
| 4,518,669 | A | 5/1985 | Yashiki | |
| 4,579,801 | A | 4/1986 | Yashiki | |
| 4,775,605 | A | 10/1988 | Seki et al. | |
| 5,017,449 | A | 5/1991 | Yoshihara | |
| 5,344,734 | A | 9/1994 | Monbaliu et al. | |
| 5,489,496 | A | 2/1996 | Katayama et al. | |
| 5,641,599 | A | 6/1997 | Markovics et al. | |
| 5,656,407 | A | 8/1997 | Kawahara | |
| 5,670,284 | A * | 9/1997 | Kishi et al. | 430/57.1 |
| 5,721,080 | A | 2/1998 | Terrell et al. | |
| 6,180,309 | B1 | 1/2001 | Maty et al. | |
| 6,200,716 | B1 | 3/2001 | Fuller et al. | |
| 6,207,334 | B1 | 3/2001 | Dinh et al. | |
| 7,267,917 | B2 | 9/2007 | Tong et al. | |
| 2009/0130575 | A1 * | 5/2009 | Coggan et al. | 430/58.8 |

OTHER PUBLICATIONS

Copending U.S. Appl. No. 12/332,541, filed Dec. 11, 2008, entitled "Imaging Member," with the named inventors Gregory McGuire and Ah-Me Hor.

Copending U.S. Appl. No. 12/332,558, filed Dec. 11, 2008, entitled "Imaging Member," with the named inventors Gregory McGuire and Ah-Me Hor.

Copending U.S. Appl. No. 12/332,571, filed Dec. 11, 2008, entitled "Imaging Member," with the named inventors Gregory McGuire and Ah-Me Hor.

* cited by examiner

*Primary Examiner* — Hoa V Le
(74) *Attorney, Agent, or Firm* — Judith L. Byorick

(57) ABSTRACT

Disclosed is an imaging member comprising a conductive substrate, a photogenerating layer comprising a photogenerating material in contact with the substrate, and a charge transport layer in contact with the photogenerating layer, the charge transport layer comprising a charge transport material, an organic phosphite or organic phosphonite antioxidant, and a hydroquinone antioxidant, wherein the photogenerating layer is situated between the charge transport layer and the conductive substrate.

15 Claims, 1 Drawing Sheet

IMAGING MEMBER

CROSS-REFERENCE TO RELATED APPLICATIONS

U.S. application Ser. No. 12/332,541, filed concurrently herewith, entitled "Imaging Member," with the named inventors Gregory McGuire and Ah-Me Hor, the disclosure of which is totally incorporated herein by reference, discloses an imaging member comprising a conductive substrate, a photogenerating layer comprising a photogenerating material in contact with the substrate, a first charge transport layer in contact with the photogenerating layer, said first charge transport layer comprising a charge transport material and a polymer containing carboxylic acid groups or groups capable of forming carboxylic acid groups, and a second charge transport layer in contact with the first charge transport layer, said second charge transport layer comprising a charge transport material and a hydroquinone antioxidant, wherein the first charge transport layer is situated between the second charge transport layer and the photogenerating layer.

U.S. application Ser. No. 12/332,558, filed concurrently herewith, entitled "Imaging Member," with the named inventors Gregory McGuire and Ah-Me Hor, the disclosure of which is totally incorporated herein by reference, discloses an imaging member comprising a conductive substrate, a photogenerating layer comprising a photogenerating material in contact with the substrate, and a charge transport layer in contact with the photogenerating layer, said charge transport layer comprising a charge transport material, a polymer containing carboxylic acid groups or groups capable of forming carboxylic acid groups, and a hydroquinone antioxidant, wherein the photogenerating layer is situated between the charge transport layer and the conductive substrate.

U.S. application Ser. No. 12/332,571, filed concurrently herewith, entitled "Imaging Member," with the named inventors Gregory McGuire and Ah-Me Hor, the disclosure of which is totally incorporated herein by reference, discloses an imaging member comprising a conductive substrate, a photogenerating layer comprising a photogenerating material in contact with the substrate, a first charge transport layer in contact with the photogenerating layer, said first charge transport layer comprising a charge transport material and an organic phosphite or organic phosphonite antioxidant, and a second charge transport layer in contact with the first charge transport layer, said second charge transport layer comprising a charge transport material and a hydroquinone antioxidant, wherein the first charge transport layer is situated between the second charge transport layer and the photogenerating layer.

BACKGROUND

Disclosed herein are improved photosensitive imaging members. More specifically, disclosed herein are imaging members exhibiting improved electrical and photodischarge properties and improved lateral charge migration resistance. One embodiment is directed to an imaging member comprising a conductive substrate, a photogenerating layer comprising a photogenerating material in contact with the substrate, and a charge transport layer in contact with the photogenerating layer, said charge transport layer comprising a charge transport material, an organic phosphite or organic phosphonite antioxidant, and a hydroquinone antioxidant, wherein the photogenerating layer is situated between the charge transport layer and the conductive substrate.

The formation and development of images on the surface of photoconductive materials by electrostatic means is well known, and is commonly referred to, variously, as electrophotography, xerography, electrophotographic imaging, electrostatographic imaging, and the like. The basic electrophotographic imaging process, as taught by C. F. Carlson in U.S. Pat. No. 2,297,691, entails placing a uniform electrostatic charge on a photoconductive imaging member (also commonly referred to as a photoreceptor), which can be in the form of a plate, drum, belt, or any other desired form, exposing the imaging member to a light and shadow image to dissipate the charge on the areas of the imaging member exposed to the light, and developing the resulting electrostatic latent image by depositing on the image a finely divided electroscopic material known as toner. In the Charge Area Development (CAD) scheme, the toner will normally be attracted to those areas of the imaging member which retain a charge, thereby forming a toner image corresponding to the electrostatic latent image. In the Discharge Area Development (DAD) scheme, the toner will normally be attracted to those areas of the imaging member which are uncharged, thereby forming a toner image corresponding to a negative of the electrostatic latent image. The developed image can then be transferred to a substrate such as paper. The transferred image can subsequently be permanently affixed to the substrate by heat, pressure, a combination of heat and pressure, or other suitable fixing means such as solvent or overcoating treatment.

Photoreceptor materials comprising inorganic or organic materials wherein the charge generating and charge transport functions are performed by discrete contiguous layers are known. Additionally, layered photoreceptor members are disclosed in the prior art, including photoreceptors having an overcoat layer of an electrically insulating polymeric material. Other layered photoresponsive devices have been disclosed, including those comprising separate photogenerating layers and charge transport layers as described in U.S. Pat. No. 4,265,990, the disclosure of which is totally incorporated herein by reference. Photoresponsive materials containing a hole injecting layer overcoated with a hole transport layer, followed by an overcoating of a photogenerating layer, and a top coating of an insulating organic resin, are disclosed in U.S. Pat. No. 4,251,612, the disclosure of which is totally incorporated herein by reference. Examples of photogenerating layers disclosed in these patents include trigonal selenium and phthalocyanines, while examples of transport layers include certain aryl diamines as illustrated therein.

In addition, U.S. Pat. No. 3,041,167 discloses an overcoated imaging member containing a conductive substrate, a photoconductive layer, and an overcoating layer of an electrically insulating polymeric material. This member can be employed in electrophotographic imaging processes by initially charging the member with an electrostatic charge of a first polarity, followed by exposing it to form an electrostatic latent image that can subsequently be developed to form a visible image.

Additional conventional photoreceptors and their materials are disclosed in, for example, U.S. Pat. Nos. 5,489,496, 4,579,801, 4,518,669, 4,775,605, 5,656,407, 5,641,599, 5,344,734, 5,721,080, 5,017,449, 6,200,716, 6,180,309, and 6,207,334, the disclosures of each of which are totally incorporated herein by reference.

While known materials and devices are suitable for their intended purposes, a need remains for improved photosensitive imaging members. For example, it is desirable to increase the surface discharge speed of the photoreceptor to allow for higher speed printing applications. It is also desirable to minimize any Lateral Charge Migration (LCM) and to minimize changes in the electrical characteristics of the photoreceptor during prolonged electrical cycling. Lateral charge migration is the movement of charges on or near the surface of an almost insulating photoconductor surface, and has the effect of smoothing out the spatial variations in the surface charge density profile of the latent image. It can be caused by a number of different substances or events, such as ionic contaminants from the environment, naturally occurring charging device effluents, and the like, which cause the charges to move. LCM can occur locally or over the entire photoconductor surface. As a result, some of the fine features present in the input image may not be present in the final print. Increasing the print speed without changing the print engine architecture reduces the time from the exposure stage to the development stage, which reduces the time available for the photoreceptor's surface to discharge. If the charges are still in transit, a higher surface voltage on the photoreceptor remains during development, which consequently has a negative impact on print quality. To solve this problem, high discharge rate charge transport molecules have been tested in the hopes of enabling increased print speeds. N,N,N'N'-Tetra(4-methylphenyl)-(1,1'-biphenyl)-4,4'-diamine is one example of a high discharge rate charge transport molecule. High discharge rate charge transport molecules, however, also tend to exhibit undesirably high lateral charge migration, and attempts at reducing the LCM tend to entail some decrease of discharge rate to improve LCM. It would be highly desirable to reduce LCM while either leaving discharge rate unchanged or improving discharge rate.

As used herein, "discharge rate" refers to the voltage drop over time and is based upon a discharge over a discharge interval at a given light intensity, wherein discharge is defined as the voltage drop or difference between the initial surface voltage before light exposure and the surface voltage after light exposure at the end of the discharge interval. Discharge interval is defined as the time period from the light exposure stage to the development stage (which is essentially the time available for the photoreceptor surface to discharge from an initial voltage to a development voltage) and light intensity is defined as the intensity of light used to generate discharge in the photoreceptor. The exposure light intensity influences the amount of discharge, and increasing or decreasing light intensity will respectively increase or decrease the voltage drop over a given discharge interval.

SUMMARY

Disclosed herein is an imaging member comprising a conductive substrate, a photogenerating layer comprising a photogenerating material in contact with the substrate, and a charge transport layer in contact with the photogenerating layer, said charge transport layer comprising a charge transport material, an organic phosphite or organic phosphonite antioxidant, and a hydroquinone antioxidant, wherein the photogenerating layer is situated between the charge transport layer and the conductive substrate.

DETAILED DESCRIPTION

Figure 1:
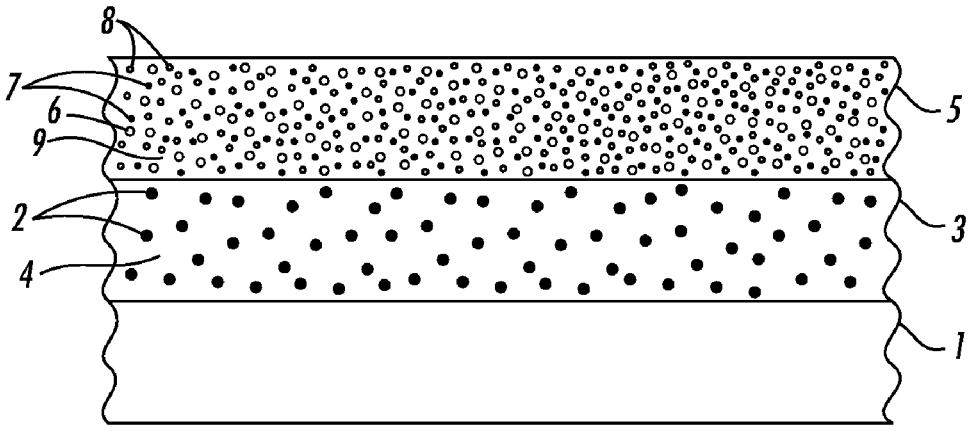
FIGS. 1 and 2 are schematic cross-sectional views of examples of photoconductive imaging members of the present invention.

FIG. 1 illustrates schematically one embodiment of the imaging members of the present invention. Specifically, FIG. 1 shows a photoconductive imaging member comprising a conductive substrate 1, a photogenerating layer 3 comprising a photogenerating compound 2 dispersed in a resinous binder composition 4, and a charge transport layer 5, which comprises a charge transporting molecule 7 dispersed in a resinous binder composition 9. Also dispersed in resinous binder composition 9 are organic phosphite or organic phosphonite antioxidant 6 and hydroquinone compound 8.

Figure 2:
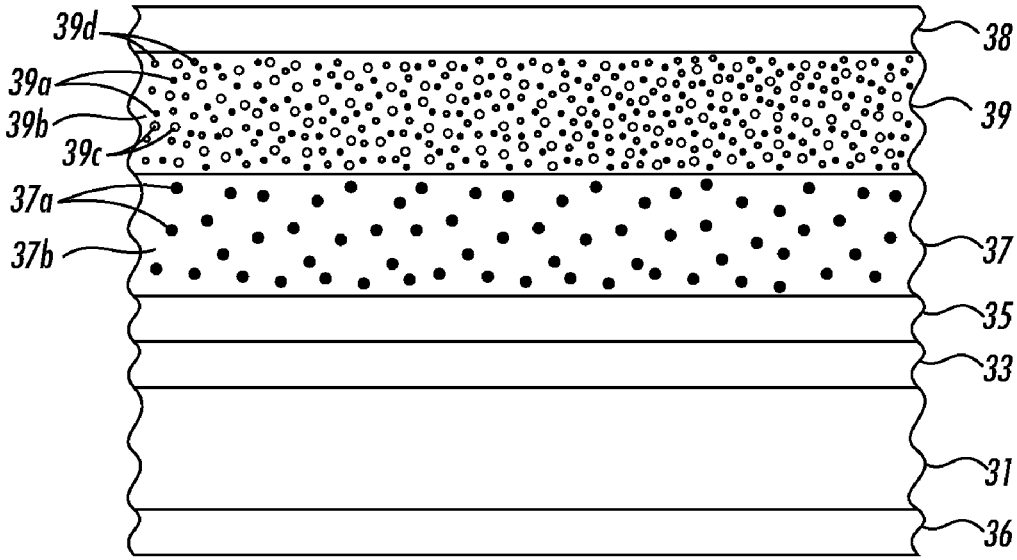

FIG. 2 illustrates schematically a photoconductive imaging member of the present invention comprising a conductive substrate 31, an optional charge blocking metal oxide layer 33, an optional adhesive layer 35, a photogenerating layer 37 comprising a photogenerating compound 37*a* dispersed in a resinous binder composition 37*b*, a charge transport layer 39 comprising a charge transport compound 39*a*, organic phosphite or organic phosphonite antioxidant 39*c*, and hydroquinone compound 39*d* dispersed in a resinous binder 39*b*, an optional anticurl backing layer 36, and an optional protective overcoating layer 38.

The substrate can be formulated entirely of an electrically conductive material, or it can be an insulating material having an electrically conductive surface. The substrate is of any desired or effective thickness, in one embodiment at least about 1 mil, and in one embodiment no more than about 100 mils, and in another embodiment no more than about 50 mils, although the thickness can be outside of these ranges. The thickness of the substrate layer can vary depending on many factors, including economic and mechanical considerations. Thus, this layer can be of substantial thickness, for example over 100 mils, or of minimal thickness provided that there are no adverse effects on the system. Similarly, the substrate can be either rigid or flexible. In one specific embodiment, the thickness of this layer is from about 3 mils to about 10 mils. For flexible belt imaging members, in one specific embodiment substrate thicknesses are at least about 65 microns, and in another embodiment at least about 75 microns, and in one embodiment no more than about 150 microns, and in another embodiment no more than about 100 microns, although the thicknesses can be outside of these ranges, for optimum flexibility and minimum stretch when cycled around small diameter rollers of, for example, about 19 millimeters in diameter.

The substrate can be opaque or substantially transparent and can comprise numerous suitable materials having the desired mechanical properties. The entire substrate can comprise the same material as that in the electrically conductive surface or the electrically conductive surface can be merely a coating on the substrate. Any suitable electrically conductive material can be employed. Examples of electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, combinations thereof, and the like. The conductive layer can vary in thickness over substantially wide ranges depending on the desired use of the electrophotoconductive member. In various embodiments, the conductive layer can range in thickness from about 50 Angstroms to many centimeters, although the thickness can be outside of this range. When a flexible electrophotographic imaging member is desired, the thickness of the conductive layer is in one embodiment at least about 20 Angstroms, and in another embodiment at least about 100 Angstroms, and in one embodiment no more than about 750 Angstroms, and another embodiment no more than about 200 Angstroms, although the thickness can be outside of these ranges, for an optimum combination of electrical conductivity, flexibility, and light transmission. When the selected substrate comprises a non-conductive base and an electrically conductive layer coated thereon, the substrate can be of any other conventional material, including organic and inorganic materials. Examples of substrate materials include insulating non-conducting materials such as various resins known for this purpose including polycarbonates, polyamides, polyurethanes, paper, glass, plastic, polyesters such as MYLAR® or MELINEX®, and the like. The conductive layer can be coated onto the base layer by any suitable coating technique, such as vacuum deposition or the like. If desired, the substrate can comprise a metallized plastic, such as titanized or aluminized MYLAR®, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, a Möbius strip, an endless flexible belt, or the like. The outer surface of the substrate can comprise a metal oxide such as aluminum oxide, nickel oxide, titanium oxide, or the like.

The photoconductive imaging member can optionally contain a charge blocking layer situated between the conductive substrate and the photogenerating layer. Electron blocking layers for positively charged photoreceptors allow holes from the imaging surface of the photoreceptor to migrate toward the conductive layer, while hole blocking layers for negatively charged photoreceptors allow electrons from the imaging surface of the photoreceptor to migrate toward the conductive layer. This layer can comprise metal oxides, such as aluminum oxide and the like, or materials such as silanes and nylons, nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl)methyl diethoxysilane, and $[H_2N(CH_2)_3]CH_3Si(OCH_3)_2$ (gamma-aminopropyl)methyl diethoxysilane, as disclosed in U.S. Pat. Nos. 4,291,110, 4,338,387, and 4,286,033, the disclosures of each of which are totally incorporated herein by reference, or the like, as well as combinations thereof. Additional examples of suitable materials include gelatin dissolved in water and methanol, polyvinyl alcohol, polyamides, gamma-aminopropyl triethoxysilane, polyisobutyl methacrylate, copolymers of styrene and acrylates such as styrene/n-butyl methacrylate, copolymers of styrene and vinyl toluene, polycarbonates, alkyl substituted polystyrenes, styrene-olefin copolymers, polyesters, polyurethanes, polyterpenes, silicone elastomers, mixtures or blends thereof, copolymers thereof, and the like. One specific example of a blocking layer comprises a reaction product between a hydrolyzed silane and the oxidized surface of a metal ground plane layer. The oxidized surface inherently forms on the outer surface of most metal ground plane layers when exposed to air after deposition. The primary purpose of this layer is to prevent charge injection from the substrate during and after charging. This layer is of a thickness of in one embodiment at least about 50 Angstroms, and in one embodiment no more than about 10 microns, in another embodiment no more than about 2 microns, and in yet another embodiment no more than about 0.2 micron, although the thickness can be outside of these ranges.

The blocking layer can be applied by any suitable conventional technique such as spraying, dip coating, draw bar coating, gravure coating, silk screening, air knife coating, reverse roll coating, vacuum deposition, chemical treatment, or the like. For convenience in obtaining thin layers, the blocking layers can be applied in the form of a dilute solution, with the solvent being removed after deposition of the coating by conventional techniques such as by vacuum, heating, and the like.

In some cases, intermediate adhesive layers between the substrate and subsequently applied layers can be desirable to improve adhesion. If such adhesive layers are used, they can have a dry thickness of in one embodiment at least about 0.1 micron, and in one embodiment no more than about 5 microns, although the thickness can be outside of these ranges. Examples of adhesive layers include film-forming polymers such as polyesters, polyvinylbutyrals, polyvinylpyrrolidones, polycarbonates, polyurethanes, polymethylmethacrylates, and the like as well as mixtures thereof. Since the surface of the substrate can be a charge blocking layer or an adhesive layer, the expression "substrate" as employed herein is intended to include a charge blocking layer with or without an adhesive layer on a charge blocking layer. Examples of adhesive layer thicknesses are in one embodiment at least about 0.05 micron (500 Angstroms), and in one embodiment no more than about 0.3 micron (3,000 Angstroms), although the thickness can be outside of these ranges. Conventional techniques for applying an adhesive layer coating mixture to the substrate include spraying, dip coating, roll coating, wire wound rod coating, gravure coating, Bird bar applicator coating, or the like. Drying of the deposited coating can be effected by any suitable conventional technique, such as oven drying, infrared radiation drying, air drying, or the like.

Optionally, an overcoat layer can also be used to improve resistance to abrasion. In some cases an anticurl back coating can also be applied to the surface of the substrate opposite to that bearing the photoconductive layer to provide flatness and/or abrasion resistance where a web configuration photoreceptor is fabricated. These overcoating and anticurl back coating layers are well known in the art, and can comprise thermoplastic organic polymers or inorganic polymers that are electrically insulating or slightly semiconductive. Overcoatings are continuous and have thicknesses in one embodiment of less than about 10 microns, although the thicknesses can be outside of these ranges. The thickness of anticurl backing layers generally is sufficient to balance substantially the total forces of the layer or layers on the opposite side of the substrate layer. An example of an anticurl backing layer is described in U.S. Pat. No. 4,654,284, the disclosure of which is totally incorporated herein by reference. A thickness of in one embodiment at least about 70 microns, and in one embodiment no more than about 160 microns is suitable for flexible photoreceptors, although the thicknesses can be outside of these ranges.

The photogenerating layer can comprise single or multiple layers comprising inorganic or organic compositions and the like. One example of a generator layer is described in U.S. Pat. No. 3,121,006, the disclosure of which is totally incorporated herein by reference, wherein finely divided particles of a photoconductive inorganic compound are dispersed in an electrically insulating organic resin binder. Multi-photogenerating layer compositions can be used where a photoconductive layer enhances or reduces the properties of the photogenerating layer. Examples of this type of configuration are described in U.S. Pat. No. 4,415,639, the disclosure of which is totally incorporated herein by reference. Further examples of photosensitive members having at least two electrically operative layers include the charge generator layer and diamine containing transport layer members disclosed in U.S. Pat. Nos. 4,265,990, 4,233,384, 4,306,008, and 4,299,897, the disclosures of each of which are totally incorporated herein by reference; dyestuff generator layer and oxadiazole, pyrazalone, imidazole, bromopyrene, nitrofluorene and nitronaphthalimide derivative containing charge transport layers members, as disclosed in U.S. Pat. No. 3,895,944, the disclosure of which is totally incorporated herein by reference; generator layer and hydrazone containing charge transport layers members, disclosed in U.S. Pat. No. 4,150,987, the disclosure of which is totally incorporated herein by reference; generator layer and a tri-aryl pyrazoline compound containing charge transport layer members, as disclosed in U.S. Pat. No. 3,837,851, the disclosure of which is totally incorporated herein by reference; and the like.

The photogenerating or photoconductive layer contains any desired or suitable photoconductive material. The photoconductive layer or layers can contain inorganic or organic photoconductive materials. Examples of inorganic photoconductive materials include amorphous selenium, trigonal selenium, alloys of selenium with elements such as tellurium, arsenic, and the like, amorphous silicon, cadmium sulfoselenide, cadmium selenide, cadmium sulfide, zinc oxide, titanium dioxide and the like. Inorganic photoconductive materials can, if desired, be dispersed in a film forming polymer binder.

Examples of organic photoconductors include various phthalocyanine pigments, such as the X-form of metal free phthalocyanine described in U.S. Pat. No. 3,357,989, the disclosure of which is totally incorporated herein by reference, metal phthalocyanines such as vanadyl phthalocyanine, copper phthalocyanine, and the like, quinacridones, substituted 2,4-diamino-triazines as disclosed in U.S. Pat. No. 3,442,781, the disclosure of which is totally incorporated herein by reference, polynuclear aromatic quinones, dibromoanthanthrones, squaryliums, pyrazolones, polyvinylcarbazole-2,4,7-trinitrofluorenone, anthracene, benzimidazole perylenes, polynuclear aromatic quinones, and the like. Many organic photoconductor materials can also be used as particles dispersed in a resin binder.

Examples of suitable binders for the photoconductive materials include thermoplastic and thermosetting resins such as polycarbonates, polyesters, including polyethylene terephthalate, polyurethanes, polystyrenes, polybutadienes, polysulfones, polyarylethers, polyarylsulfones, polyethersulfones, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly (N-vinylpyrrolidinone)s, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers can be block, random, or alternating copolymers.

When the photogenerating material is present in a binder material, the photogenerating composition or pigment can be present in the film forming polymer binder compositions in any suitable or desired amounts. For example, in one embodiment the photogenerating pigment is dispersed in the film forming polymer binder composition in an amount of at least about 10 percent by volume, in another embodiment at least about 20 percent by volume, and in yet another embodiment at least about 30 percent by volume, and in one embodiment the photogenerating pigment is dispersed in the film forming polymer binder composition in an amount of no more than about 60 percent by volume, although the amount can be outside of these ranges. The photoconductive material is present in the photogenerating layer in an amount in one embodiment of at least about 5 percent by weight, and in another embodiment at least about 25 percent by weight, and in one embodiment no more than about 80 percent by weight, and in another embodiment no more than about 75 percent by weight, and the binder is present in an amount of in one embodiment at least about 20 percent by weight, and in another embodiment at least about 25 percent by weight, and in one embodiment no more than about 95 percent by weight, and in another embodiment no more than about 75 percent by weight, although the relative amounts can be outside of these ranges.

The particle size of the photoconductive compositions and/or pigments in one specific embodiment is less than the thickness of the deposited solidified layer, and in one specific embodiment is at least about 0.01 micron, and in another specific embodiment is no more than about 0.5 micron, to facilitate better coating uniformity.

The photogenerating layer containing photoconductive compositions and the resinous binder material has a thickness in one embodiment of at least about 0.05 micron, in another embodiment at least about 0.1 micron, and in yet another embodiment at least about 0.3 micron, and in one embodiment no more than about 10 microns, in another embodiment no more than about 5 microns, and in yet another embodiment no more than about 3 microns, although the thickness can be outside of these ranges. The photogenerating layer thickness is related to the relative amounts of photogenerating compound and binder, with the photogenerating material often being present in amounts of from about 5 to about 100 percent by weight. Higher binder content compositions generally lead to thicker layers for photogeneration. It is desirable in many embodiments to provide this layer in a thickness sufficient to absorb about 90 percent or more of the incident radiation which is directed upon it in the imagewise or printing exposure step. The maximum thickness of this layer is dependent primarily upon factors such as mechanical considerations, specific photogenerating compound selected, the thicknesses of the other layers, and whether a flexible photoconductive imaging member is desired.

The photogenerating layer can be applied to underlying layers by any desired or suitable method. Any suitable technique can be used to mix and thereafter apply the photogenerating layer coating mixture. Examples of application techniques include spraying, dip coating, roll coating, wire wound rod coating, and the like. Drying of the deposited coating can be effected by any suitable technique, such as oven drying, infra red radiation drying, air drying, and the like.

Any other suitable multilayer photoconductors can also be employed in the imaging member. Some multilayer photoconductors comprise at least two electrically operative layers, a photogenerating or charge generating layer and a charge transport layer.

The charge transport layer can comprise any suitable charge transport material. The active charge transport layer can consist entirely of the desired charge transport material, or can comprise an activating compound useful as an additive dissolved or molecularly dispersed in electrically inactive polymeric materials making these materials electrically active. The term "dissolved" as employed herein is defined as forming a solution in which the small molecule is dissolved in the polymer to form a homogeneous phase. The expression "molecularly dispersed" as used herein is defined as a charge transporting small molecule dispersed in the polymer, the small molecules being dispersed in the polymer on a molecular scale. The expression charge transporting "small molecule" is defined herein as a monomer that allows photogenerated free charges to be transported across the transport layer. These compounds can be added to polymeric materials which are incapable of supporting the injection of photogenerated holes or electrons from the generation material and incapable of allowing the transport of these holes or electrons therethrough, thereby converting the electrically inactive polymeric material to a material capable of supporting the injection of photogenerated holes or electrons from the generation material and capable of allowing the transport of these holes or electrons through the active layer in order to discharge the surface charge on the active layer.

One specific suitable charge transport material is N,N,N'N'-tetra(4-methylphenyl)-(1,1'-biphenyl)-4,4'-diamine, of the formula

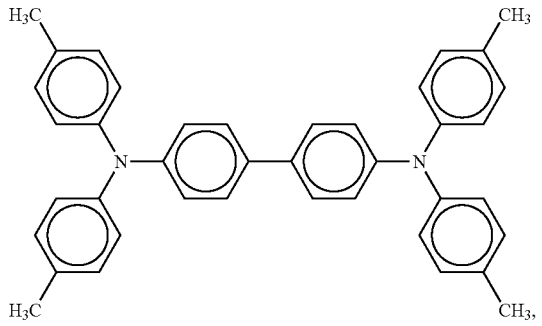

as disclosed in, for example, U.S. Patent Publication 20080102388, U.S. patent application Ser. No. 11/756,109, filed May 31, 2007, and European Patent Publication EP 1 918 779 A1, the disclosures of each of which are totally incorporated herein by reference.

The charge transport material is present in the charge transport layer in any desired or effective amount, in one embodiment at least about 5 percent by weight, in another embodiment at least about 20 percent by weight, and in yet another embodiment at least about 30 percent by weight, and in one embodiment no more than about 90 percent by weight, in another embodiment no more than about 75 percent by weight, and in another embodiment no more than about 60 percent by weight, although the amount can be outside of these ranges.

Also present in the charge transport layer is an organic phosphite or organic phosphonite antioxidant. Examples of suitable organic phosphite or organic phosphonite antioxidants include phosphorous acid, bis[2,4-(1,1-dimethylethyl)-6-methylphenyl]ethyl ester, commercially available as IRGAFOS® 38 from Ciba Specialty Chemicals, tris(2,4-di-t-butylphenyl)phosphite, commercially available as IRGAFOS® 168 from Ciba Specialty Chemicals, tris-nonylphenyl phosphate, tetrakis-(2,4-di-t-butylphenyl)-4,4'-biphenylen-di-phosphonite, commercially available as IRGAFOS® P-EPQ, (2,4,6-tri-t-butylphenyl)-2-butyl-2-ethyl-1,3-propanediol phosphite, commercially available as ULTRANOX® 641 from Crompton Corp., tetrakis-(2,4-di-t-butylphenyl)-4,4'-biphenylen-di-phosphonite, commercially available as ALKANOX® 24-44, bis-(2,4-di-t-butylphenol) pentaerythritol, commercially available as IRGAFOS® 126 from Ciba Specialty Chemicals, di-n-octyl phosphite, commercially available as IRGAFOS® OPH from Ciba Specialty Chemicals, 2,2'2"-nitrilo [triethyl-tris[3,3',5,5'-tetra-tert-butyl-1,1'-biphenyl-2,2'-diyl]]phosphite, commercially available as IRGAFOS® 12 from Ciba Specialty Chemicals, bis (2,4-di-t-butylphenyl)pentaerythritol diphosphite, commercially available as ULTRANOX® 627A from Crompton Corp., and the like, as well as mixtures thereof.

Organic antioxidants of this type can also be prepared as disclosed in, for example, European Patent Publication EP 0511156, the disclosure of which is totally incorporated herein by reference. More specifically, 2,4-di-tert-butyl-6-methylphenol, phosphorous trichloride, and a catalytic amount of DMF can be heated at 130 to 140° C., followed by cooling the mixture and diluting with a special boiling point spirit, cooling to −5° C., and treating with triethylamine. Methanol is then added dropwise and the mixture is stirred to +5° C. to give bis(2-methyl-4,6-bis(1,1-dimethylethyl)phenyl) phosphorous acid ethylester.

The organic phosphite or organic phosphonite antioxidant is present in the charge transport layer in any desired or effective amount, in one embodiment at least about 1 percent by weight, in another embodiment at least about 3 percent by weight, in yet another embodiment at least about 5 percent by weight, and in still another embodiment at least about 6 percent by weight, and in one embodiment no more than about 20 percent by weight, in another embodiment no more than about 15 percent by weight, and in yet another embodiment no more than about 10 percent by weight, although the amount can be outside of these ranges.

Also present in the charge transport layer is a hydroquinone antioxidant. Examples of suitable hydroquinone antioxidants include hydroquinone, 2,5-di-tert-butyl-1,4-hydroquinone, 2,5-di-tert-amyl-1,4-hydroquinone, mono-t-butylhydroquinones, such as 2-tert-butyl-1,4-hydroquinone, mono-t-amylhydroquinones, such as 2-tert-amyl-1,4-hydroquinone, toluhydroquinones, mono-octylhydroquinones, mono-nonylhydroquinones, mono-decylhydroquinones, and the like, as well as mixtures thereof.

The hydroquinone antioxidant is present in the charge transport layer in any desired or effective amount, in one embodiment at least about 1 percent by weight, in another embodiment at least about 3 percent by weight, in yet another embodiment at least about 5 percent by weight, and in still another embodiment at least about 6 percent by weight, and in one embodiment no more than about 20 percent by weight, in another embodiment no more than about 15 percent by weight, and in yet another embodiment no more than about 10 percent by weight, although the amount can be outside of these ranges.

Examples of the highly insulating and transparent resinous components or inactive binder resinous material for the transport layers include materials such as those described in U.S. Pat. No. 3,121,006, the disclosure of which is totally incorporated herein by reference. Specific examples of suitable organic resinous materials include polycarbonates, such as MAKROLON 5705 from Farbenfabriken Bayer AG or FPC0170 from Mitsubishi Gas Chemical Co., acrylate polymers, vinyl polymers, cellulose polymers, polyesters, polysiloxanes, polyamides, polyurethanes, polystyrenes, polyarylates, polyethers, polysulfones, and epoxies, as well as block, random or alternating copolymers thereof. Specific examples include polycarbonates such as poly(4,4'-isopropylidene-diphenylene)carbonate (also referred to as bisphenol-A-polycarbonate, poly(4,4'-cyclohexylidinediphenylene) carbonate (referred to as bisphenol-Z polycarbonate), poly(4,4'-isopropylidene-3,3'-dimethyl-diphenyl)carbonate (also referred to as bisphenol-C-polycarbonate), and the like. Specific examples of electrically inactive binder materials include polycarbonate resins having a number average molecular weight of from about 20,000 to about 150,000 with a molecular weight in the range of from about 50,000 to about 100,000 being particularly preferred. Any suitable charge transporting polymer can also be used in the charge transporting layer.

Any suitable and conventional technique can be used to mix and thereafter apply the charge transport layer coating mixture to the charge generating layer. Examples of application techniques include spraying, dip coating, roll coating, wire wound rod coating, and the like. Drying of the deposited coating can be effected by any suitable conventional technique such as oven drying, infra red radiation drying, air drying, and the like.

The thickness of the charge transport layer or layers is in one embodiment at least about 10 microns, and in one embodiment no more than about 50 microns, although thicknesses outside this range can also be used. In one specific embodiment, the ratio of the thickness of the charge transport layer to the charge generator layer is maintained from about 2:1 to about 200:1, and in some instances as great as about 400:1, although the ratio can be outside of these ranges.

Other layers, such as a conventional electrically conductive ground strip along one edge of the belt in contact with the conductive layer, blocking layer, adhesive layer, or charge generating layer to facilitate connection of the electrically conductive layer of the photoreceptor to ground or to an electrical bias, can also be included. Ground strips are well known and usually comprise conductive particles dispersed in a film forming binder.

Optionally, an overcoat layer can also be used to improve resistance to abrasion. In some cases an anti-curl back coating can be applied to the surface of the substrate opposite to that bearing the photoconductive layer to provide flatness and/or abrasion resistance. These overcoating and anti-curl back coating layers are well known in the art and can comprise thermoplastic organic polymers or inorganic polymers that are electrically insulating or slightly semi-conductive. Overcoatings are continuous and in specific embodiments have a thickness of less than about 10 microns. The thicknesses of anti-curl backing layers are in specific embodiments sufficient to substantially balance the total forces of the layer or layers on the opposite side of the supporting substrate layer. The total forces are substantially balanced when the belt has no noticeable tendency to curl after all the layers are dried. An example of an anti-curl backing layer is described in U.S. Pat. No. 4,654,284 the disclosure of which is totally incorporated herein by reference. A thickness of in one embodiment at least about 70 microns and in one embodiment no more than about 160 microns is a satisfactory range for flexible photoreceptors, although the thickness can be outside of these ranges.

Also disclosed herein is a method of generating images with the photoconductive imaging members disclosed herein. The method comprises generating an electrostatic latent image on a photoconductive imaging member, developing the latent image, and optionally transferring the developed electrostatic image to a substrate. Optionally, the image can be permanently affixed to the substrate. Development of the image can be achieved by a number of methods, such as cascade, touchdown, powder cloud, magnetic brush, and the like. Transfer of the developed image to a substrate can be by any method, including those making use of a corotron or a biased charging roll. The fixing step can be performed by means of any suitable method, such as radiant flash fusing, heat fusing, pressure fusing, vapor fusing, and the like. Any material used in xerographic copiers and printers can be used as a substrate, such as paper, transparency material, or the like.

Specific embodiments will now be described in detail. These examples are intended to be illustrative, and the claims are not limited to the materials, conditions, or process parameters set forth in these embodiments. All parts and percentages are by weight unless otherwise indicated.

EXAMPLE I

Comparative/Control

A hydroxygallium phthalocyanine/poly(bisphenol-Z carbonate) photogenerating layer on a metallized MYLAR® substrate was prepared by machine solution coating a mixture containing about 50 percent by weight hydroxygallium phthalocyanine and about 50 percent by weight poly (bisphenol-Z carbonate) (obtained from Mitsubishi Gas Co.) to a dry thickness of about 0.6 microns onto a MYLAR® substrate about 75 microns thick having an aluminum coating thereon about 100 Angstroms thick. A charge transport layer was then prepared by introducing into an amber glass bottle 50 weight percent of high quality N,N,N'N'-tetra(4-methylphenyl)-(1,1'-biphenyl)-4,4'-diamine, obtained from Sensient Imaging Technologies and purified in-house (this compound can be purified to a purity of 98 to 100 percent by train sublimation, a Kaufmann column run with alumina and a non-polar solvent such as hexane, hexanes, cyclohexane, heptane and the like, absorbent treatments such as with the use of alumina, clay, charcoal and the like and recrystallization to produce the desired purity), and 50 weight percent of MAKROLON 5705® polycarbonate binder polymer, obtained from Farbenfabriken Bayer A.G. The resulting mixture was then dissolved in methylene chloride to form a solution containing 15 percent by weight solids. This solution was applied using web coating on the photogenerating layer to form a layer coating that upon drying (120° C. for 1 minute) had a thickness of 30 microns.

EXAMPLE II

Comparative/Control

The process of Example I was repeated except that the charge transport layer coating mixture was prepared by introducing into an amber glass bottle 46.5 weight percent of high quality N,N,N'N'-tetra(4-methylphenyl)-(1,1'-biphenyl)-4,4'-diamine, 46.5 weight percent of MAKROLON 5705® polycarbonate binder polymer, obtained from Farbenfabriken Bayer A.G., and 7 weight percent of 2,5-di(tert-amyl)hydroquinone (obtained from Mayzo).

EXAMPLE III

Comparative/Control

The process of Example I was repeated except that the charge transport layer coating mixture was prepared by introducing into an amber glass bottle 46.5 weight percent of high quality N,N,N'N'-tetra(4-methylphenyl)-(1,1'-biphenyl)-4,4'-diamine, 46.5 weight percent of MAKROLON 5705® polycarbonate binder polymer, obtained from Farbenfabriken Bayer A.G., and 7 weight percent of phosphorous acid, bis[2,4-(1,1-dimethylethyl)-6-methylphenyl]ethyl ester (IRGAFOS® 38, obtained from Ciba Specialty Chemicals).

EXAMPLE IV

The process of Example I was repeated except that the charge transport layer coating mixture was prepared by introducing into an amber glass bottle 43 weight percent of high quality N,N,N'N'-tetra(4-methylphenyl)-(1,1'-biphenyl)-4,4'-diamine, 43 weight percent of MAKROLON 5705® polycarbonate binder polymer, obtained from Farbenfabriken Bayer A.G., 7 weight percent of phosphorous acid, bis[2,4-(1,1-dimethylethyl)-6-methylphenyl]ethyl ester, and 7 weight percent of 2,5-di(tert-amyl)hydroquinone (obtained from Mayzo).

TESTING

The test devices prepared in Examples I through IV were tested in terms of electrical and photodischarge characteristics.

Electrical and photodischarge characteristics were evaluated by measuring the surface potential of the photoconductor at specified time intervals before and after various photo exposure energies. Discharge rate was determined by electrostatically charging the surfaces of the imaging members with a corona device, in the dark until the surface potential attained an initial value of about 800 volts, as measured by a ESV probe attached to an electrometer. The surface potential was then measured again by an ESV probe after 400 ms in the dark. The difference between these measured values is the Dark Decay (surface potential drop in the absence of photo exposure). The devices were then exposed to light energy for 200 ms having a wavelength of 780 nm from a filtered xenon lamp. A reduction in the surface potential due to photo discharge effect ($V_{Iow}$) was measured at 500 milliseconds after photo discharge for various exposure light energies. The exposure light energy ranged from about 10 ergs per centimeter squared to zero ergs per centimeter squared. The light exposure energy gives a photo induced discharge curve (PIDC). Dark Decay and $V_{Iow}$ measurements at 6 ergs per centimeter squared light exposure energy are used for comparison of Examples I through IV.

For the imaging member prepared in Example I, dark decay was 35 Volts, and $V_{Iow}$ at 6 ergs/cm$^2$ was 30 V. The imaging member exhibited relatively high speed discharge. The imaging member exhibited a relatively low discharge voltage at 500 ms exposed to measurement time at various light intensities. These data indicate a relatively high discharge rate and good photodischarge performance.

For the imaging member prepared in Example II., dark decay was 3 Volts and $V_{Iow}$ was 165 V at 6 ergs/cm$^2$. The imaging member exhibited very poor discharge characteristics with increased discharge voltage when compared to the imaging member of Example I.

For the imaging member prepared in Example III, dark decay was 100 V and $V_{Iow}$ was 14 V at 6 ergs/cm$^2$. The imaging member exhibited very poor charge acceptance, high dark decay, high charge depletion, and generally undesirable photodischarge properties compared to Example I.

For the imaging member prepared in Example IV, dark decay was 5 Volts and $V_{Iow}$ was 25 V at 6 ergs/cm$^2$. The imaging member exhibited excellent charging characteristics, with excellent charge acceptance, low dark decay, low charge depletion, and generally excellent photodischarge characteristics.

Cycling performance of a photoconductor is evaluated by charging and photodischarging repeatedly at one specific light exposure energy of 10 ergs per centimeter squared. Cycle up refers to the increase in discharge voltage (surface potential after light exposure) over repeated charge-photo discharge cycles. It is desirable to minimize any change in discharge voltage over repeated charge-photo discharge cycles. Electrical cycling data is expressed as a change in discharge voltage ($\Delta V$) over 10,000 cycles measured at 10 ergs per centimeter squared light exposure energy. In terms of cycle up, the imaging member of Example II exhibited severe cycle up, going from about 32 to about 52 Volts over 10,000 cycles, while the imaging member of Example IV exhibited very little cycle up, going from 2 to about 3 Volts over 10,000 cycles. In terms of cycle up, the imaging member of Example II exhibited significant cycle up of 32 Volts, while the imaging member of Example IV exhibited very little cycle up, increasing around 4 Volts over 10,000 cycles.

Lateral Charge Migration (LCM) resistance was evaluated by a lateral charge migration (LCM) print testing scheme. The above prepared hand coated imaging members were cut into 6"×1" strips. One end of each strip from the respective devices was cleaned using a solvent to expose the metallic conductive layer on the substrate. The conductivity of the exposed metallic Ti—Zr conductive layer was then measured to ensure that the metal had not been removed during cleaning. The conductivity of the exposed metallic Ti—Zr conductive layer was measured using a multimeter to measure the resistance across the exposed metal layer (around 1 KOhm). A fully operational 85 mm DC12 XEROX® standard DocuColor photoreceptor drum was then prepared to expose a strip around the drum to provide the ground for the handcoated device when it was operated. The cleaning blade was removed from the drum housing to prevent it from removing the hand coated devices during operation. The imaging members from the Examples were then mounted onto the photoreceptor drum using conductive copper tape to adhere the exposed conductive end of the devices to the exposed aluminum strip on the drum to complete a conductive path to the ground. After mounting the devices, the device-to-drum conductivity was measured using a standard multimeter in a resistance mode. The resistance between the respective devices and the drum was expected to be similar to the resistance of the conductive coating on the respective hand coated devices. The ends of the devices were then secured to the drum using 3M SCOTCH® tape, and all exposed conductive surfaces were covered with SCOTCH® tape. The drum was then placed in a DocuColor 12 (DC12) machine and a template containing 1 bit, 2 bit, 3 bit, 4 bit, and 5 bit lines was printed. The machine settings (developer bias, laser power, grid bias) were adjusted to obtain visible print that resolved the 5 individual lines above. If the 1 bit line was barely showing, then the settings were saved and the print became the reference, or the pre-exposure print. The drum was removed and placed in a charge-discharge apparatus that generated corona discharge during operation. The drum was charged and discharged (cycled) for 10,000 cycles to induce deletion (LCM). The drum was then removed from the apparatus and placed in the DC12 machine and the template was printed again.

The data are expressed as the number of printed bit lines remaining (not deleted due to LCM). The imaging member of Example III could not be charged, and thus was not tested. The imaging members of Examples II and IV exhibited no lateral charge migration, and printed all 5 lines of the image. The imaging member of Example I exhibited severe lateral charge migration, printing 0 lines, and the image was substantially washed out.

The above data are summarized in the table below:

| | Dark Decay (Volts) | $V_{low}$ (Volts at 6 erg/cm$^2$ | ΔV (10K at 10 erg/cm$^2$) | LCM (# lines) |
|---|---|---|---|---|
| Example I | 35 | 30 | 3 | 0 |
| Example II | 3 | 165 | 32 | 5 |
| Example III | 100 | 14 | N/A | N/A |
| Example IV | 5 | 25 | 4 | 5 |

As the results indicate, only the imaging member prepared in Example IV exhibits both no lateral charge migration and highly desirable charging characteristics.

EXAMPLE V

The process of Example IV is repeated except that the 2,5-di(tert-amyl)hydroquinone in the charge transport layer is replaced with 2,5-di(tert-butyl)hydroquinone. It is believed that similar results will be obtained.

EXAMPLE VI

The process of Example IV is repeated except that the 2,5-di(tert-amyl)hydroquinone in the charge transport layer is replaced with 2-tert-butyl hydroquinone. It is believed that similar results will be obtained.

EXAMPLE VII

The process of Example IV is repeated except that the 2,5-di(tert-amyl)hydroquinone in the charge transport layer is replaced with 2-tert-amyl hydroquinone. It is believed that similar results will be obtained.

EXAMPLE VIII

The process of Example IV is repeated except that the phosphorous acid, bis[2,4-(1,1-dimethylethyl)-6-methylphenyl]ethyl ester in the charge transport layer is replaced with [phosphorous acid-cyclic butylethyl propanediol, 2,4,6-tri-t-butylphenyl ester], commercially available as ULTRANOX® 641 from Crompton Corp. It is believed that similar results will be obtained.

Other embodiments and modifications of the present invention may occur to those of ordinary skill in the art subsequent to a review of the information presented herein; these embodiments and modifications, as well as equivalents thereof, are also included within the scope of this invention.

The recited order of processing elements or sequences, or the use of numbers, letters, or other designations therefor, is not intended to limit a claimed process to any order except as specified in the claim itself.

What is claimed is:

1. An imaging member comprising a conductive substrate, a photogenerating layer comprising a photogenerating material in contact with the substrate, and a charge transport layer in contact with the photogenerating layer, said charge transport layer comprising a charge transport material, an organic phosphite or organic phosphonite antioxidant selected from (a) phosphorous acid, bis[2,4-(1,1-dimethylethyl)-6-methylphenyl]ethyl ester; (b) [phosphorous acid-cyclic butylethyl propanediol, 2,4,6-tri-t-butylphenyl ester]; or (c) mixtures thereof, and a hydroquinone antioxidant, wherein the photogenerating layer is situated between the charge transport layer and the conductive substrate.

2. An imaging member according to claim 1 wherein the organic phosphite or organic phosphonite antioxidant is phosphorous bis[2,4-bis(1,1-dimethylethyl)-6-methylphenyl] ethyl ester.

3. An imaging member according to claim 1 wherein the organic phosphite or organic phosphonite antioxidant is present in the charge transport layer in an amount of at least about 1 percent by weight.

4. An imaging member according to claim 1 wherein the organic phosphite or organic phosphonite antioxidant is present in the charge transport layer in an amount of at least about 3 percent by weight.

5. An imaging member according to claim 1 wherein the organic phosphite or organic phosphonite antioxidant is present in the charge transport layer in an amount of at least about 5 percent by weight.

6. An imaging member according to claim 1 wherein the organic phosphite or organic phosphonite antioxidant is present in the charge transport layer in an amount of no more than about 20 percent by weight.

7. An imaging member according to claim 1 wherein the organic phosphite or organic phosphonite antioxidant is present in the charge transport layer in an amount of no more than about 10 percent by weight.

8. An imaging member according to claim 1 wherein the hydroquinone antioxidant is selected from hydroquinone, 2,5-di-tert-butyl-1,4-hydroquinone, 2,5-di-tert-amyl-1,4-hydroquinone, mono-t-butylhydroquinones, such as 2-tert-butyl-1,4-hydroquinone, mono-t-amylhydroquinones, such as 2-tert-amyl-1,4-hydroquinone, toluhydroquinones, mono-octylhydroquinones, mono-nonylhydroquinones, mono-decylhydroquinones, or mixtures thereof.

9. An imaging member according to claim 1 wherein the hydroquinone antioxidant is 2,5-di-tert-butyl-1,4-hydroquinone or 2,5-di-tert-amyl-1,4-hydroquinone.

10. An imaging member according to claim 1 wherein the hydroquinone antioxidant is present in the charge transport layer in an amount of at least about 1 percent by weight.

11. An imaging member according to claim 1 wherein the hydroquinone antioxidant is present in the charge transport layer in an amount of at least about 3 percent by weight.

12. An imaging member according to claim 1 wherein the hydroquinone antioxidant is present in the charge transport layer in an amount of no more than about 20 percent by weight.

13. An imaging member according to claim 1 wherein the hydroquinone antioxidant is present in the charge transport layer in an amount of no more than about 10 percent by weight.

14. An imaging member according to claim 1 wherein the charge transport material in the charge transport layer is N,N,N'N'-tetra (4-methylphenyl)-(1,1'-biphenyl)-4,4'-diamine.

15. An imaging member comprising a conductive substrate, a photogenerating layer comprising a photogenerating material in contact with the substrate, and a charge transport layer in contact with the photogenerating layer, said charge transport layer comprising a N,N,N'N'-tetra(4-methylphenyl)-(1 ,1'-biphenyl)-4,4'-diamine charge transport material, an organic phosphite or organic phosphonite antioxidant which is phosphorous bis[2,4-bis(1,1-dimethylethyl)-6-methylphenyl]ethyl ester, and a hydroquinone antioxidant which is 2,5-di-tert-amyl-1,4-hydroquinone, wherein the photogenerating layer is situated between the charge transport layer and the conductive substrate.

* * * * *